US009220334B1

(12) United States Patent
Dodgen

(10) Patent No.: US 9,220,334 B1
(45) Date of Patent: Dec. 29, 2015

(54) QUICK FILLING AND SELF SEALING HYDRATION BAG

(71) Applicant: David M. Dodgen, Cedar Park, TX (US)

(72) Inventor: David M. Dodgen, Cedar Park, TX (US)

( * ) Notice: Subject to any disclaimer, the term of this patent is extended or adjusted under 35 U.S.C. 154(b) by 206 days.

(21) Appl. No.: 14/093,195

(22) Filed: Nov. 29, 2013

Related U.S. Application Data

(60) Provisional application No. 61/731,112, filed on Nov. 29, 2012.

(51) Int. Cl.

| | |
|---|---|
| ***A45F 3/16*** | (2006.01) |
| ***A45F 3/20*** | (2006.01) |
| ***A45F 5/00*** | (2006.01) |
| ***A45F 3/18*** | (2006.01) |
| ***A47G 19/22*** | (2006.01) |
| ***B31B 1/84*** | (2006.01) |
| ***B31B 41/00*** | (2006.01) |
| ***B65B 3/17*** | (2006.01) |

(52) U.S. Cl.
CPC ..... *A45F 3/20* (2013.01); *A47G 19/2266* (2013.01); *B31B 1/84* (2013.01); *B31B 41/00* (2013.01); *B65B 3/17* (2013.01)

(58) Field of Classification Search
CPC ..... A45F 3/16; A45F 3/04; A45F 5/00; A45F 2200/0583; A45F 3/20
USPC ..... 224/148.2, 148.4, 148.1, 148.5, 148.7
See application file for complete search history.

(56) References Cited

U.S. PATENT DOCUMENTS 177,749 A * 5/1876 Redden ..... A61F 7/086 383/36
411,954 A * 10/1889 Eggers ..... B65D 33/10 138/89
883,289 A * 3/1908 Burg ..... B67C 11/04 141/201
986,535 A * 3/1911 Adams ..... B67C 11/02 116/228
1,003,856 A * 9/1911 Adams ..... B05B 7/2408 224/148.2
1,546,016 A * 7/1925 Eisele ..... A61M 3/0245 251/368
1,647,210 A * 11/1927 Bryans ..... A61M 3/0245 220/8
2,129,983 A * 9/1938 Bacon ..... A61M 39/04 138/92
2,168,239 A * 8/1939 Reach ..... A61F 7/086 137/382
2,868,246 A * 1/1959 Nelson ..... B67C 11/04 141/286
4,796,470 A * 1/1989 Lahde ..... B67C 11/02 116/228

(Continued)

*Primary Examiner* — J. Gregory Pickett
*Assistant Examiner* — Lester L Vanterpool
(74) *Attorney, Agent, or Firm* — Rick B Yeager

(57) ABSTRACT

A hydration bag comprising a storage bag sealed to a collapsible quick filling and self-sealing fill tube, a reusable drink port connection, and a drinking tube with mouthpiece. After filling the storage bag, through the fill tube, to a desired level with water or other fluid, the storage bag is inverted, thereby collapsing and effectively sealing the fill tube against itself. Air is bled from the storage bag through the drinking tube or port. After use, the storage bag may be re-filled, or recycled. In one example, the delivery fluid delivery fittings are detachable from the storage bag and re-usable so that the storage bag and fill tube assembly is curbside recyclable. In one example, a 4 inch wide fill tube extends at 6 inches into the storage bag, with the last 5 inches creating a funnel to a 2 inch bottom width.

20 Claims, 14 Drawing Sheets

(56) References Cited

U.S. PATENT DOCUMENTS 5,115,947 A * 5/1992 McDonnell ..... A62C 15/00 141/111
5,806,726 A * 9/1998 Ho ..... B62J 11/00 222/107
6,247,619 B1 * 6/2001 Gill ..... A45F 3/20 222/105
6,820,780 B2 * 11/2004 Forsman ..... B65D 77/28 215/306
8,567,457 B2 * 10/2013 Polewarczyk ..... B60S 1/50 141/331
2002/0074369 A1 * 6/2002 Forsman ..... A45F 5/00 224/148.2
2002/0113101 A1 * 8/2002 Skillern ..... A45F 3/20 224/148.2
2005/0029319 A1 * 2/2005 Robins ..... A45F 3/20 224/148.2
2006/0163284 A1 * 7/2006 Karl ..... A45F 3/18 222/175
2006/0231561 A1 * 10/2006 Choi ..... A45F 3/20 220/714
2008/0169321 A1 * 7/2008 Fidrych ..... A45F 3/20 224/148.2

* cited by examiner

QUICK FILLING AND SELF SEALING HYDRATION BAG

RELATED APPLICATIONS

This non-provisional patent application is related to U.S. Provisional Patent Application No. 61/731,112 filed Nov. 29, 2012, and claims the benefit of that priority date.

BACKGROUND OF THE INVENTION

1. Field of Invention

This patent application relates to a storage bag with a quick filling and self-sealing fill tube, and more particularly to a hydration bag with a quick filling and self-sealing fill tube.

2. Prior Art

The prior art includes portable hydration bags and larger water storage bags.

Prior art backpack type products provide a hands-free hydration system to the customer who is drawn to the outdoors and/or activity. The reservoirs of these products must be cleaned with mild soap, warm water and/or cleaning tablets. They must be dried completely. Sanitation issues are a consideration with these existing products. Staining and taste issues are problematic.

Prior Art Camelbak™ Device

Prior art hydration devices typically provide a reusable bag in a backpack or carrier. A fill port is provided in the upper portion of the bag and a discharge port is provided in the lower portion of the bag. A portion of the bag is typically permanently secured to a portion of the fill port assembly so that the seal between the fill port assembly and the bag is formed by an adhesive, heat sealing, or welding, such as ultrasonic or RF welding.

FIG. 10 is a top view of a prior art device described in U.S. Pat. No. 6,820,780 to Forsman et al and assigned to Camel-Bak Products LLC. The device includes a fluid reservoir, or bladder, 12 with an internal compartment 16, which is adapted to store a volume of drink fluid 18. The device includes a drinking tube 22 which is attached to a lower discharge or exit port 32. The reservoir 12 includes an input port, or fill port, 40 through which drink fluid 18 may be poured into or removed from the reservoir. Fill port 40 also provides a passage through which the interior of compartment 16 may be accessed, such as for cleaning. As shown, fill port 40 includes a neck, or neck portion, 42 that extends from the body portion of the reservoir and includes an opening 44 through which drink fluid may exit the fill port. As illustrated in FIG. 3, which is an end view of the prior art device, the neck 42 may be integrally formed with reservoir 12, or separately formed and then joined to the reservoir, such as by a suitable sealing mechanism. Examples of suitable sealing mechanisms include the use of an adhesive, heat sealing, and welding, such as ultrasonic or RF welding.

Although the drinking tube could be removed from the reservoir and re-used, it is generally not practical to provide disposable bags or reservoirs for this type of design because in addition to the bag itself, portions of both the exit port assembly and the fill port assembly are permanently attached to the bag, and must be provided on the replacement bag. Therefore standard practice with these types of devices is to clean, attempt to dry, and then re-use the existing reservoir.

Prior Art Disposable Bags

U.S. Pat. No. 7,311,231 to Noell et al describes replacement or pre-filled bags with a shutoff or check valve provided on the exit port. In one embodiment, pre-filled bags are provided without the fill port. In another embodiment, bags have a fill port. In the case of user-filled replacement bags, this approach also appears to have the disadvantage of requiring portions of both the exit port assembly and the fill port assembly to be attached to the replacement bag.

Rigid Systems

U.S. Pat. No. 7,600,656 issued to Karl et al describes a rigid fluid container and cites problems with prior art bag designs:

"While some improvements have been made in such bag-like systems, the reservoirs of these systems are often expensive and difficult to clean due to their construction. Flexible or "soft-sided" reservoirs (e.g. bladders, bags, etc.) are typically constructed from two sheets of high grade plastic that are bonded or welded together along their edges to create a bag with water-tight seams. These bags then have components attached to them for filling and dispensing fluids, such as an input port with a large threaded neck to fill the bag which ice and water, and an output spout with a bonded or welded drink tube. The resulting reservoir is typically a water-tight, though expensive, assemblage of fused or bonded parts. These assemblages usually have many internal seams and corners that are difficult to clean with conventional methods. For example, these collapsible bags typically include small voids or traps that are difficult to clean and often require accessories for facilitating proper cleaning (e.g. a hanging rack, etc.) to permit cleaning fluid access and/or air circulation. In some cases, the difficulties associated with cleaning the bag tend to outweigh the usefulness of the hydration bag as a desirable system for providing hydration to a user."

Disposable Bag and Sleeve Fastening Assembly

U.S. Pat. No. 8,182,151 to applicant, describes a hydration system with disposable bag and sleeve fastening assembly. Although this bag is primarily designed to be disposable, the concept works well as a reusable bag. In one embodiment, the current invention provides a collapsible flat poly fill tube for quick loading so that it is easier to fill and seal the disposable bag. This quick fill and self sealing feature makes it easier and quicker to fill and seal than any of the current backpack hydration systems on the market.

Two-Part Closure

U.S. Pat. No. 6,176,394 to Shimko et al describes a container according to a first embodiment includes a first panel bonded to all but a segment of an opposing second panel wherein the first and the second panels define an interior chamber and wherein the unbonded segments of the first panel and the second panel define a first opening having a maximum area. Present in the first opening is a two-part linear fluid impervious closure constructed of flexible material. The first part is bonded to the first panel segment of the first opening and the second part is bonded to the second panel segment of the first opening. A spout is bonded to at least the first panel to provide fluid communication between the interior chamber and the environment, and to define an orifice having an area less than the maximum area of the first opening. In a preferred embodiment, interlocking fastener strips are used as the closure. An alternative embodiment has both panels wholly bonded together at their common periphery and a slit in the first panel defines the first opening into which the closure is located and bonded. Methods for making the containers include the steps of locating the closure in the opening and using heat and pressure to effectuate the bonds. Additional heat and pressure is applied to the longitudinal ends of the closure to cause the same to become fused and to cause extrusion of closure material into any gaps that may be present between the closure and the perimeter bonds of the panels.

Aquapodkit™

The Aquapodkit™ provides temporary emergency water storage for use in bathtubs during emergency situations. The reusable fastening/locking/dispensing sleeve device of the Aquapodkit attaches to a disposable bladder. The sleeve device is designed to accommodate a pump or siphoning device to dispense the water as needed. The Aquapodkit is designed for a large volume of family emergency water storage.

The present invention can also be added as an enhancement to the Aquapodkit to store water in bathtubs to store water for emergency situations.

Storage Bag Sealing after Filling Through Collapsible Tube

Moretti, Application No. GB5814332 describes using a collapsible fill tube that extends to near the bottom of the storage bag, and then sealing the top of the storage bag. After filling the storage bag through the fill tube, the top of the fill tube is thrust into the storage bag, and the mouth of the storage bag is closed by heat sealing. The object of the fill tube is to prevent contamination of the mouth of the storage bag prior to heat sealing.

SUMMARY OF INVENTION

The present invention was designed to address the hydration needs of the active person while considering sanitation issues and ease of use. The present invention provides an easier and faster way of filling and sealing the contents in a liquid storage bag.

In one embodiment, the present invention comprises a disposable liquid storage bag, with a collapsible self sealing fill tube, a reusable drink port connection, and a drinking tube with mouthpiece. In one example, the liquid storage bag and the flat fill tube are provided as polymers, such as polyethylene, polypropylene, or other polymer or polymer blend. In this embodiment, the present invention provides an easier and safer method of sealing and protecting the contents of the liquid storage container while attaching reusable locking system for dispensing the liquid. Instead of buying complete containment systems, the consumer is able to purchase individual storage containers (bags), when needed, and reuse the locking system. In one example, the delivery fittings are detachable and re-usable so that the storage bag and fill tube assembly is curbside recyclable.

This individual hydration system may be housed inside a backpack, fanny pack, or similar receptacle. Regular backpacks or those backpacks designed specifically for the hydration reservoir may be used to accommodate a disposable liquid container and fill tube.

The disposable liquid container or liner, with attachments, may be placed inside the permanent reservoir of an existing hydration backpack; inside the hydration backpack without the permanent reservoir; or inside the housing receptacle with the reusable outer support. In some examples, the liquid storage bag includes a hole or other mounting feature for holding the liquid storage in a backpack or carrier.

The present invention provides a disposable liquid storage bag that is easy to use and sanitary while eliminating the stains and flavors that affect the permanent reservoirs of the existing products.

In one example, the collapsible self sealing fill tube is provided as a flat polymeric tubing that is sealed across the top of a flat polymeric storage bag. Only the outside of the polymeric fill tubing is sealed to the storage bag, thereby leaving the inner portion of the storage bag and the inner portion of the fill tubing opened for filling (FIG. 5). An upper portion of the flat polymeric fill tube extends outside of the storage bag that is being filled, while the lower portion of the fill tube that extends inside the storage bag tapers and funnels liquids or other materials into the storage bag (FIG. 2). This tapering makes it easier to collapse the fill tube after filling, and provides a better seal. The flexible and pliable inner fill tube provides both convenient filling and a low-cost and rapid seal. Once filled and quickly turned upside down, the inner tubing collapses, thereby sealing the bag (FIG. 6) while still having outer extended portion (that can be folded down when contents are in bag). This folded down upper portion is available for quick refilling while in use (FIG. 5).

In another example, the delivery fittings may be cut out and recycled separately from the storage bag.

The components of the quick loading/filling bladder include a fill tube (FIG. 1B) with opening at top and funneled bottom which are sealed to a storage bag (FIG. 1A). This two-piece bag system is used to create a quick filling opening at the top of the storage bag. Once filled, the collapsible fill tube creates a secure seal to the storage bag for use in a hydration system or for other storage applications.

Directions for use include inserting the neck of the fill tube under a faucet, container or any other filling apparatus that you are pouring into the storage bag to eliminate any spilling (FIG. 5). After filling the storage bag to a desired level, quickly flip the storage bag over to have inner funneled part of bag collapse and stick together, thereby creating a leak proof or leak-resistant seal to protect the contents in the storage bag (FIG. 6). Although this seal has proved to be very reliable in both strength and vibration testing, a secondary seal can be provided by folding over or attaching a clip or other seal apparatus to the portion of the fill tube outside of the storage bag.

The quick loading/filling bag can accommodate larger or smaller storage containers and a variety of liquids. While this invention has been designed to accommodate the hydration system with disposable bag and sleeve fastening system, it could also accommodate the Aquapodkit™ or other storage applications.

The fill tube can also be used to enhance current hydration systems on the market that are not disposable. The storage bag can be of varying sizes containing liquids using the siphoning device and granular-type solids. The storage bag can be made in varying sizes to accommodate the container and contents and in varying materials. The storage bag can also connect to other fasteners, tubes and hoses for dispensing.

The storage bag and fill tube can be used to store potable water, fluids, liquids, concentrates, spices, sauces, lotions, oils, cereals, grains, salt, etc. The current invention is not limited to the aforementioned contents.

The current invention can also accommodate multiple quick loading ports for filling and or separation of certain materials/liquids, such as epoxies, before combining.

The storage bag and fill tube can be placed or stored in anything that can support its weight. The storage bag may be constructed of thicker outer materials while the inner fill tube is still very flexible and collapsible for filling, thereby providing a check valve type of operation. Possible storage places include, but are not limited to: bathtubs, sinks, crates, drums, barrels, containers, coolers, storage tanks, tubs, tanker trucks, bulk containers, backpacks, carrying bags, and fanny packs.

By providing more efficient and economical filling, sealing, and storage, the current invention permits the consumer to replace the bags only.

DETAILED DESCRIPTION OF EMBODIMENT

In one example, the hydration bag comprises a storage bag with a top portion and a bottom portion; a collapsible fill tube positioned partially within the storage bag, and a drink hole port. The collapsible fill tube has a first panel, a second panel, a top having a width, and a funnel-shaped bottom portion having a bottom opening with a width less than the top width. The first panel has an inside surface, a first side edge, and a second side edge. The second panel has an inside surface, a first side edge, and a second side edge. The first panel is connected to the second panel at the first fill tube side edge and the second fill tube side edge. An upper portion of the collapsible fill tube extends through top portion of the storage bag. A storage bag top seal is provided, in proximity to the top of the storage bag, between the storage bag and the collapsible fill tube.

In one example, the hydration bag includes a drink tube assembly comprising a first tube, external to the storage bag, the first tube having a proximal end connected to the drink hole port, and a second end.

Storage Bag

Figure 1A:
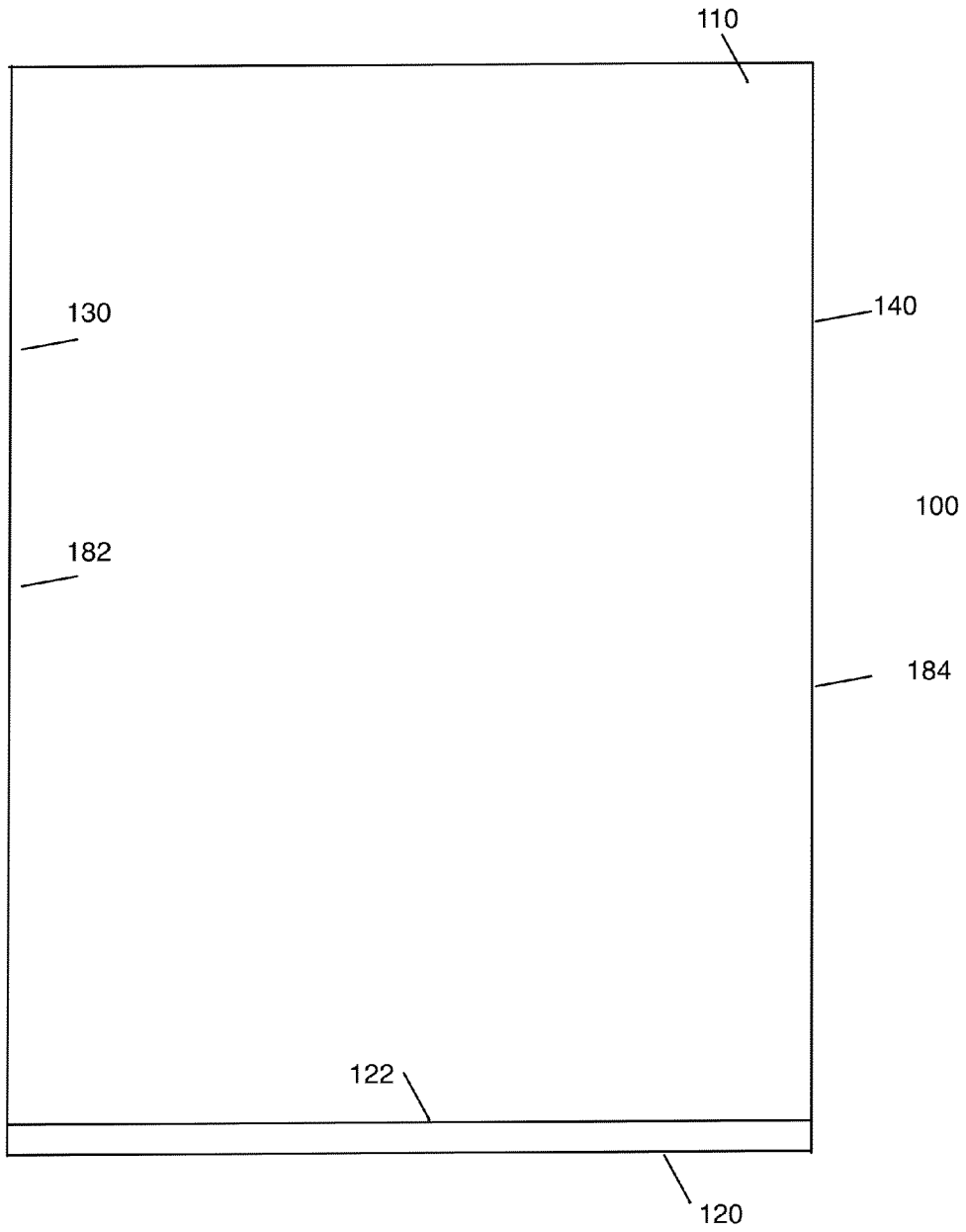
FIG. 1A shows a storage bag.

FIG. 1A is a side view of a storage bag 100 with a top 110, a bottom 120 with a bottom seal 122, a first side edge 130, and a second side edge 140.

In this specification, the term "storage bag" refers to a container for storing a liquid, granular or powdered solid, or a mixture of a liquid and a solid.

In one example, the storage bags are fabricated from two panels 150 and 160 with double side heat seal seams 170 and 172, a bottom heat seal seam 174, and heat seal seams 182 and 184 across the top portion.

In another example, the storage bags are fabricated by folding a strip of sheet material 152 upon itself to form a folded edge 153 and sealing the meeting side edges 154 and 156 together to form a side seam 157. The bottom and top edges are sealed after the material is folded.

Fill Tube

Figure 1B:
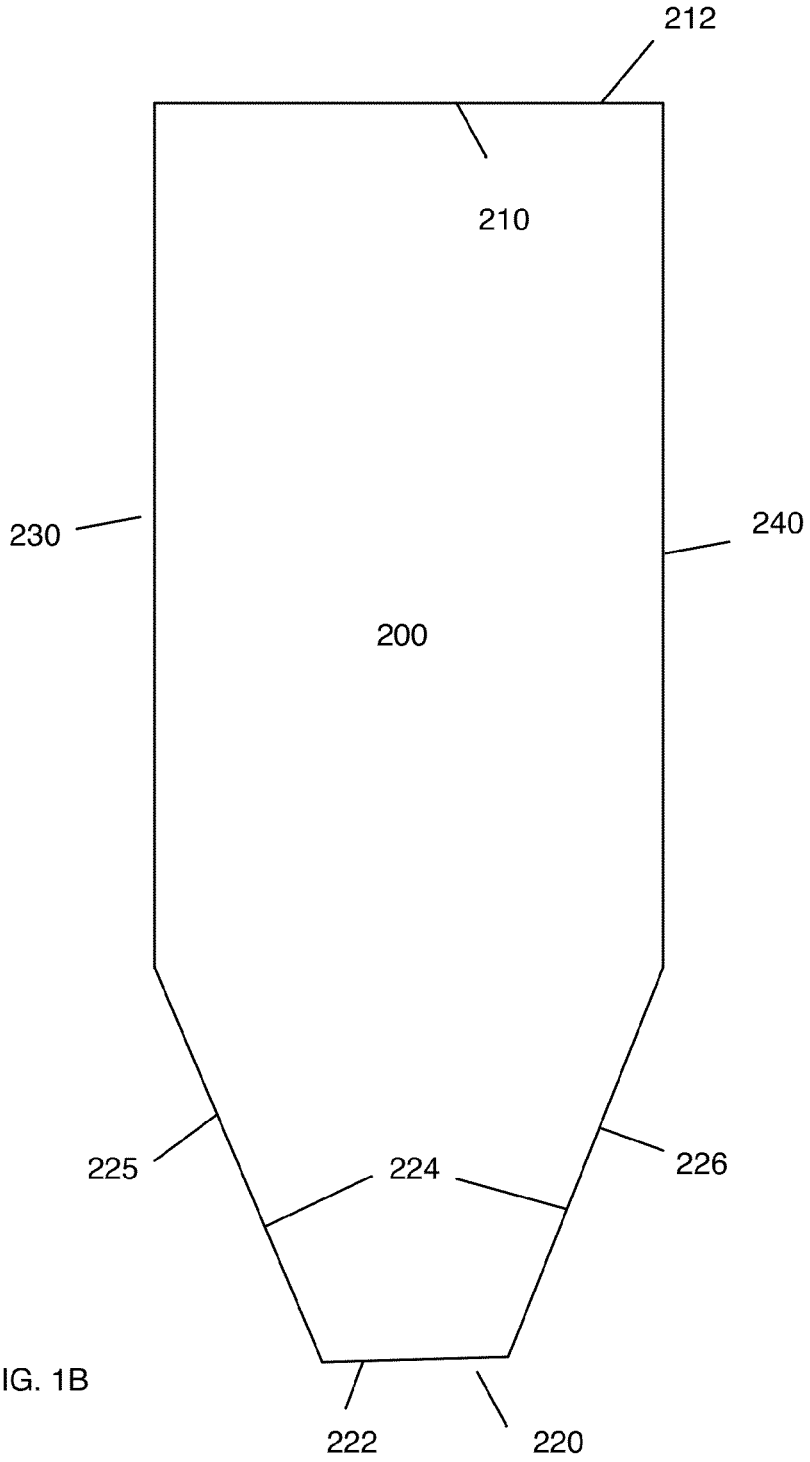
FIG. 1B shows the smaller flat fill tube with a larger filling port and a tapered extension which funnels the liquid/material into the larger storage bag of FIG. 1A.

FIG. 1B is a side view of a fill tube 200 with a top 210, a bottom 220, a first side edge 230, and a second side edge 240. The top comprises a top opening 212. The bottom comprises a bottom opening 222 and a bottom taper 224. In other examples, the bottom of the fill tube is not tapered. The fill tube may be fabricated by overlaying a first panel and a second panel and then creating seals along first side panel edges 230 and the second side panel edges 240. It is desirable to make the funnel seals 225 and 226 with the panel edges well-aligned and with as flat of seam as practical.

In this specification, the term "fill tube" refers to an element having a first side and a second side, with seals, creases, and/or folds between the edges of the first side and the edges of the second side; such that in a closed configuration, the first side lays flat against the second side; and in an open configuration the first side is at least partially spaced away from the second side to permit the flow of liquid, solid, or a mixture of liquid and solid between the first side and the second side.

In this specification, the term "collapsible fill tube" refers to a fill tube having a first side and a second side where the inside portion of first side and the inside portion of the second side are in substantial contact, thereby preventing the flow of a liquid, powder, granules, other solid, or mixture of liquid and solid for flowing between the first side and second side.

In this specification, the term "funnel portion" refers to a narrowing of the fill tube from a top width to a bottom opening substantially narrower than the top width.

Assembled Storage Bag and Fill Tube

Figure 2B:
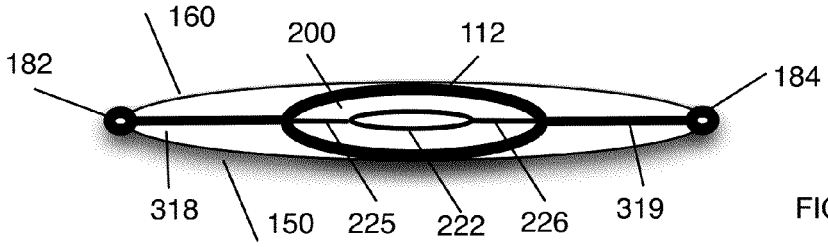
FIG. 2B is a top view of the hydration bag of FIG. 2A.
Figure 2A:
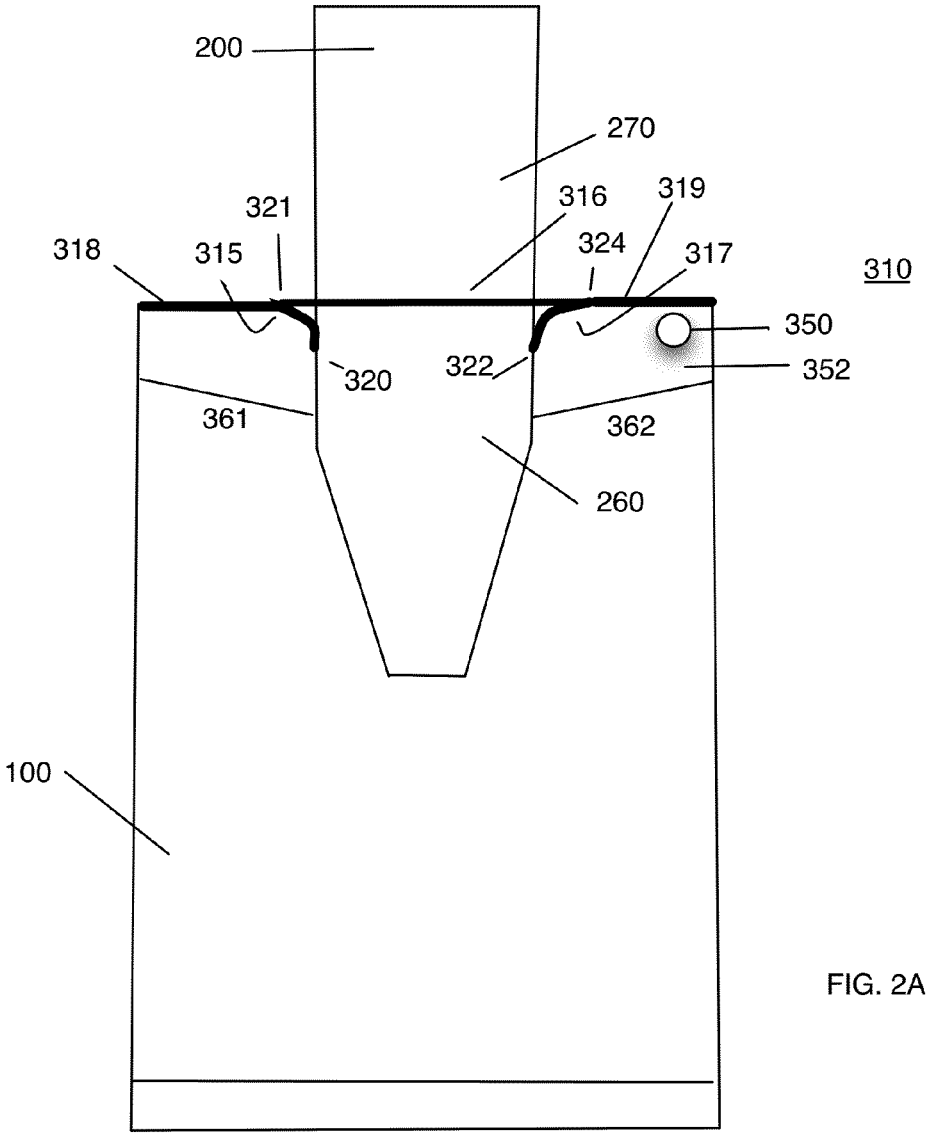
FIG. 2A shows the fill tube of FIG. 1B assembled in the storage bag of FIG. 1A to form a hydration bag.

FIG. 2A shows the fill tube 200 of FIG. 1B assembled in the storage bag 100 of FIG. 1A to form a hydration bag 310. A lower portion 260 of the fill tube extends into the storage bag 100. An upper portion 270 of the fill tube extends outwardly from the storage bag. A slot seal 316 is provided on the outside of the fill tube to seal the fill tube to the hydration bag along the top of the storage bag, leaving the inner portion of the storage bag and fill tubing opened for filling.

In FIG. 2A, the storage bag top seal includes fill tube inversion preventers 315 and 317 that are formed by heat sealing a first upwardly-convex inversion seal extending between a first point 320 on the fill tube below the top of the bag, and a second point 321 in proximity to the top of the storage bag that is wider than the fill tube, and heat sealing a second upwardly-convex inversion seal extending between a third point 322 on the fill tube below the top of the bag, and a fourth point 324 in proximity to the top of the storage bag that is wider that the fill tube. A heat seal 316 is formed between the second point and the fourth point, such that the heat seal seals the flat tubing to the first panel of the storage bag and to the second panel of the storage bag.

Figure 4:
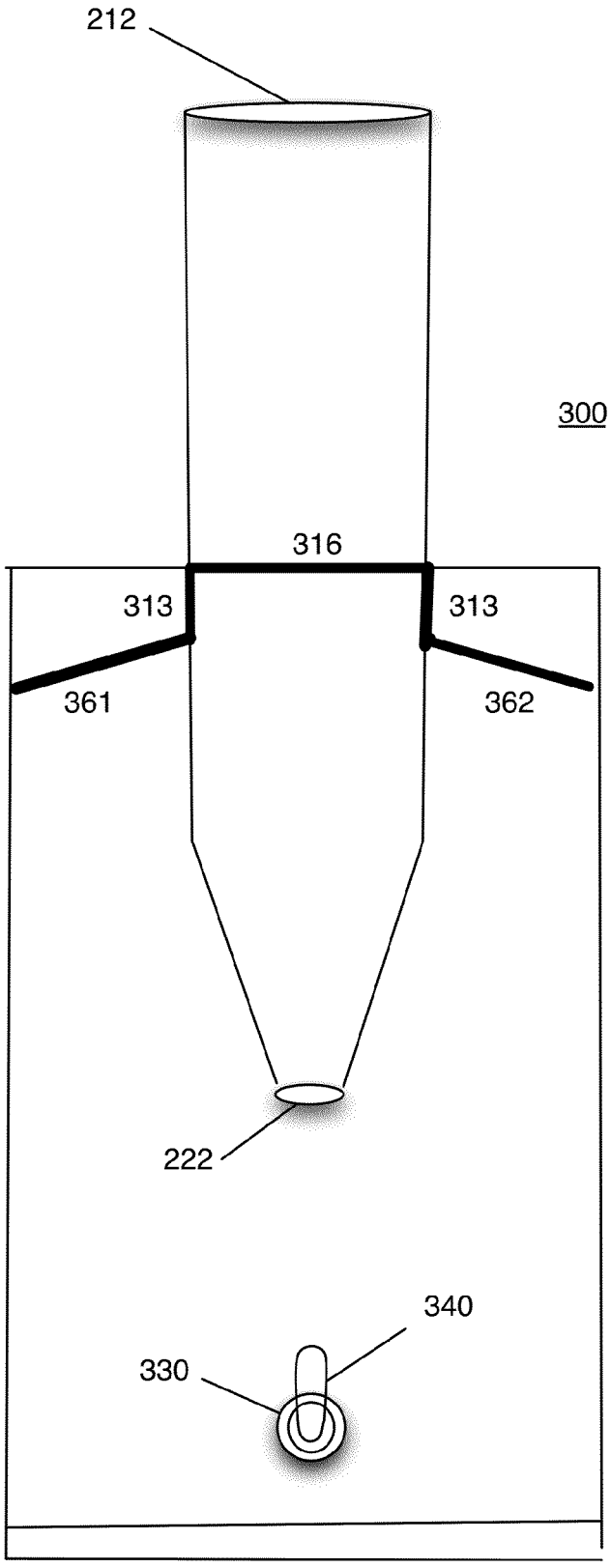
FIG. 4 shows the assembly of FIG. 3 with the locking/dispensing mechanism inserted
Figure 12:
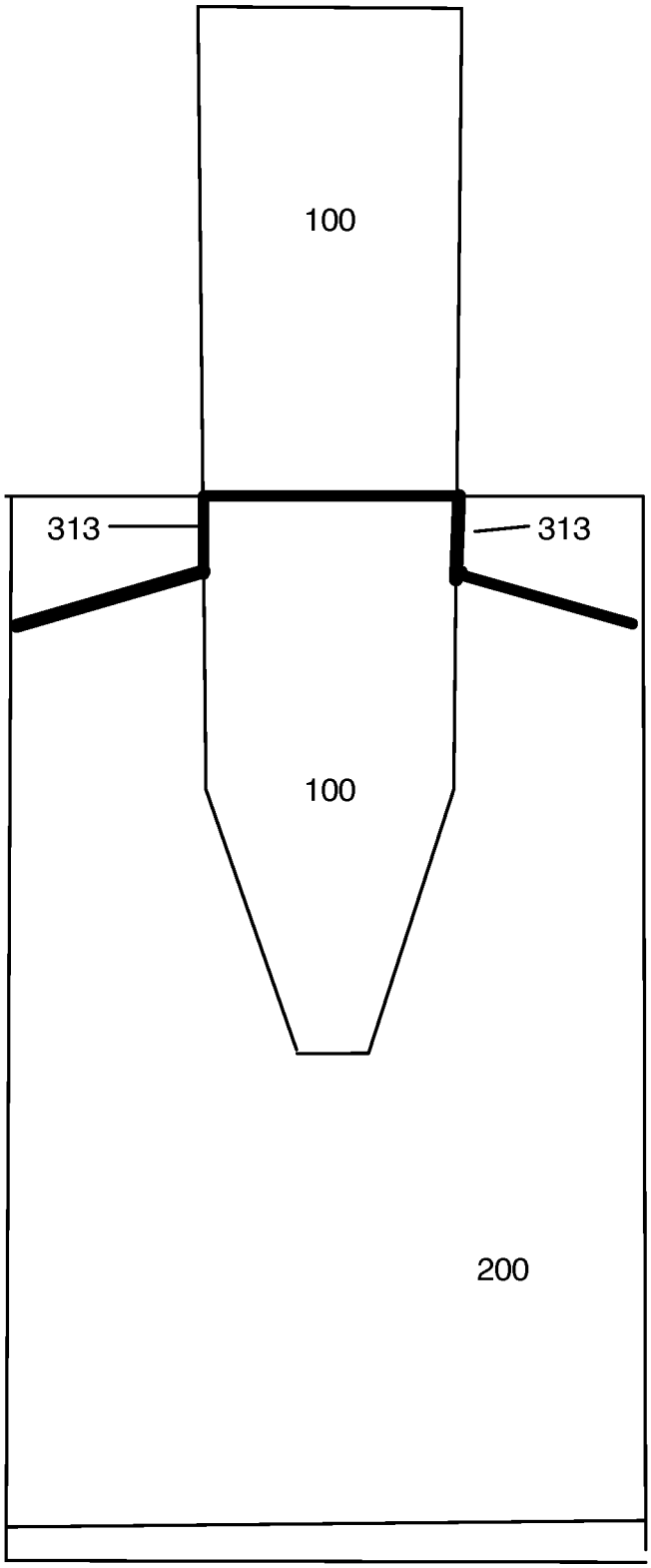
FIG. 12 is a top view of an alternate hydration bag with straight inversion prevention seals.

In other examples, the top bag seal includes a heat seal 316 to seal the flat tubing to the first panel of the storage bag and to the second panel of the storage bag; and seals 361 and 362 which are provided below the top of the storage bag and preferable angel upwards toward the sides of the storage bag. When these seals 361 and 362 are used the fill tube inversion preventers may be straight sections 313 as shown in FIG. 12 and FIG. 4 which extend downward from the top seal 316 to intersect the seals 361 and 362.

The top seal 316 has extensions 318 and 319 so that the seals 316, 318, and 319 extend across the top the of the storage bag from the first side edge to the second side edge of the storage bag, respectively. In FIG. 2A, a mounting hole 350 is provided in the unfilled area 352 between the fill tube and the second side of the storage bag. The mounting hole can be used to support the hydration bag in a hydration backpack.

FIG. 2B is a top view of the hydration bag of FIG. 2A. The heavy lines represents the top seal 316 between the storage bag and the fill tube 200, which is shown partially open for illustration, and the seals 318 and 319 which seal the top of the storage bag. The storage bag front panel 150 and rear panel 160 are shown separated below the seal for illustration, with heat seals 182 and 184 exaggerated for illustration. The fill tube typically has similar construction with a front panel and a rear panel with good alignment ad a flat seal at the edges. The top view shows the bottom opening 222, and funnel edge seals 325 and 326.

EXAMPLE

An example that has been effective for hydration bags is with a fill tube about 4 inches wide with a 5 inch long funnel which narrows to a 2 inch opening (which is large enough for ice cubes). The fill tube extends 6 inches into the storage bag. The fill line is below the bottom of the funnel. The air above the fill line may be bled through the drink tube, or may be left in the storage bag.

The 3 inches of the fill tube which extends outside of the storage bag is typically turned down, and may be clipped to form a secondary seal. However, testing has shown the collapsed fill tube to be very effective at sealing the contents. Tape has been used effectively on the outside top edges of the storage bag to reinforce the top of the storage bag and the mounting hole. The fill tube is typically constructed of tubing.

The fill tube 200 is inserted partially into the top 110 of the storage bag 100. In this example, the bottom of the fill tube 110 extends 6 inches into the storage bag. Testing has shown that longer fill tubes are more effective at closure than shorter fill tubes.

The upper portion 270 of the fill tube typically extends several inches above the top 110 of the storage bag in order to provide more convenient filling of the storage bag, or optional secondary fill tube seal.

The lower end 260 of the fill tube preferably extends substantially below the top of the storage bag.

Orientation of the Fill Tube

In the examples shown, the fill tube is provided in the center of the storage bag. In other examples, the fill tube may be offset to one side of the storage bag. Testing has shown that the fill tube should not be located too close to the edges of the storage bag.

Figure 3:
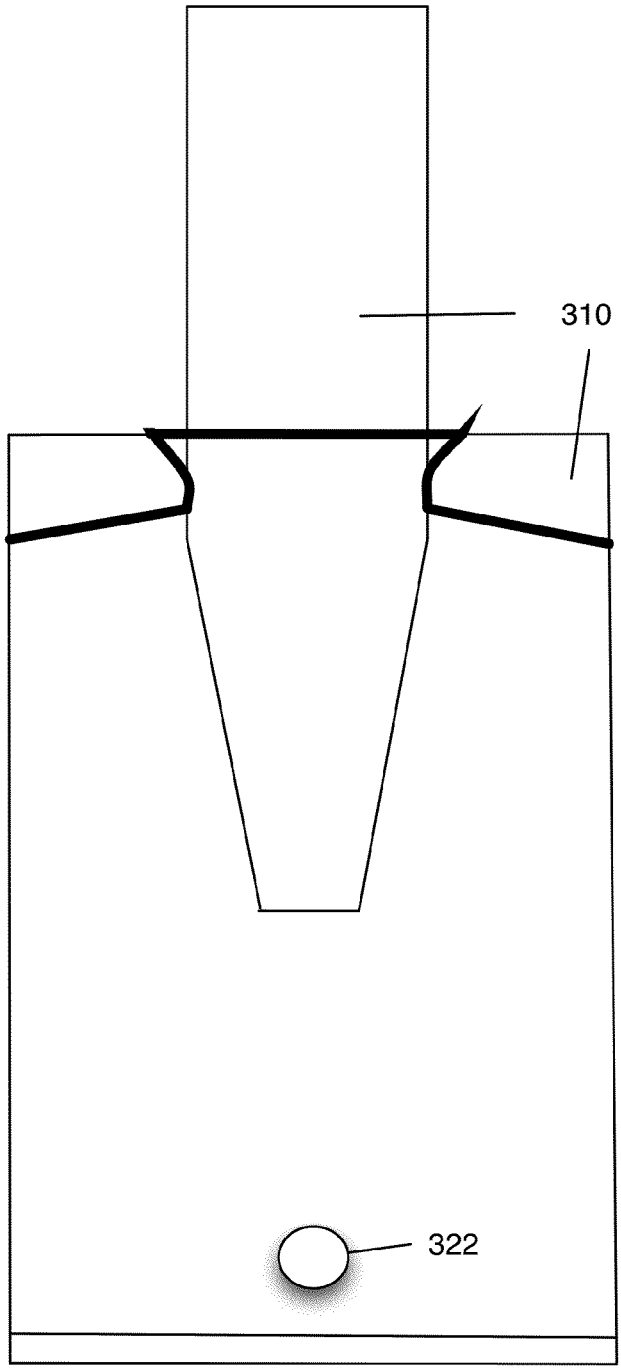
FIG. 3 shows the assembly of FIG. 2 with a hole for inserting a locking/dispensing mechanism.

FIG. 3 shows the hydration bag 310 of FIG. 2 with a hole 322 for inserting a drink tube locking and dispensing mechanism.

In this example, a hydration bag is formed from a larger flat polymeric storage bag (FIG. 1A) and a smaller flat collapsible polymeric fill tube (FIG. 1B) which has a larger filling port and a tapered extension which funnels the liquid/material into the larger storage bag.

FIG. 4 shows a hydration bag assembly 300 formed by adding a locking and dispensing mechanism 340 to the hydration bag 310. The locking and dispensing mechanism 340 forms a hydration port 330. FIG. 4 shows storage bag seals 361, 362, and 316 with straight extensions 313.

Bottom Drinking Port

In this embodiment, a fill tube is provided in the liquid storage bag, and a separate drinking tube port is provided at the bottom of the bag. In one example, a removable fitting is provided to seal the drinking tube port and to attach connectors and drinking tube components.

EXAMPLE

Drinking Tube Assembly

One example of drinking tube assembly is to provide a rotatable connector such as United States Plastic Corp. Part No. 60656 "Bulkhead Panel Mounted Hose Barb Body & Shutoff" on the drinking hole port. The lower portion of the connector has a hose barb for attaching a tube section, and the upper portion of the connector has a shutoff connection. The mouthpiece tube may be attached to the barb end of United States Plastic Corp. Part No. 60658 "Hose Barb Insert with Shutoff", and that part is attachable to the rotatable connector.

A mouthpiece tube section of the drinking tube may have a Y-connector such as United States Plastic Corp. Part No. 64116 to permit the contents of the bag to be shared. Each mouthpiece section(s) may include a dispensing valve. The mouthpiece tube section is typically long enough to reach from the cap to the mouth of a user.

EXAMPLE

Bulkhead Fitting

In another example, a bulkhead fitting comprises a bolt portion with a threaded hole; a nut portion; and gaskets. Hole periphery storage bag material is sealed between the gaskets as the nut portion is tightened onto the bolt portion.

Figure 5:
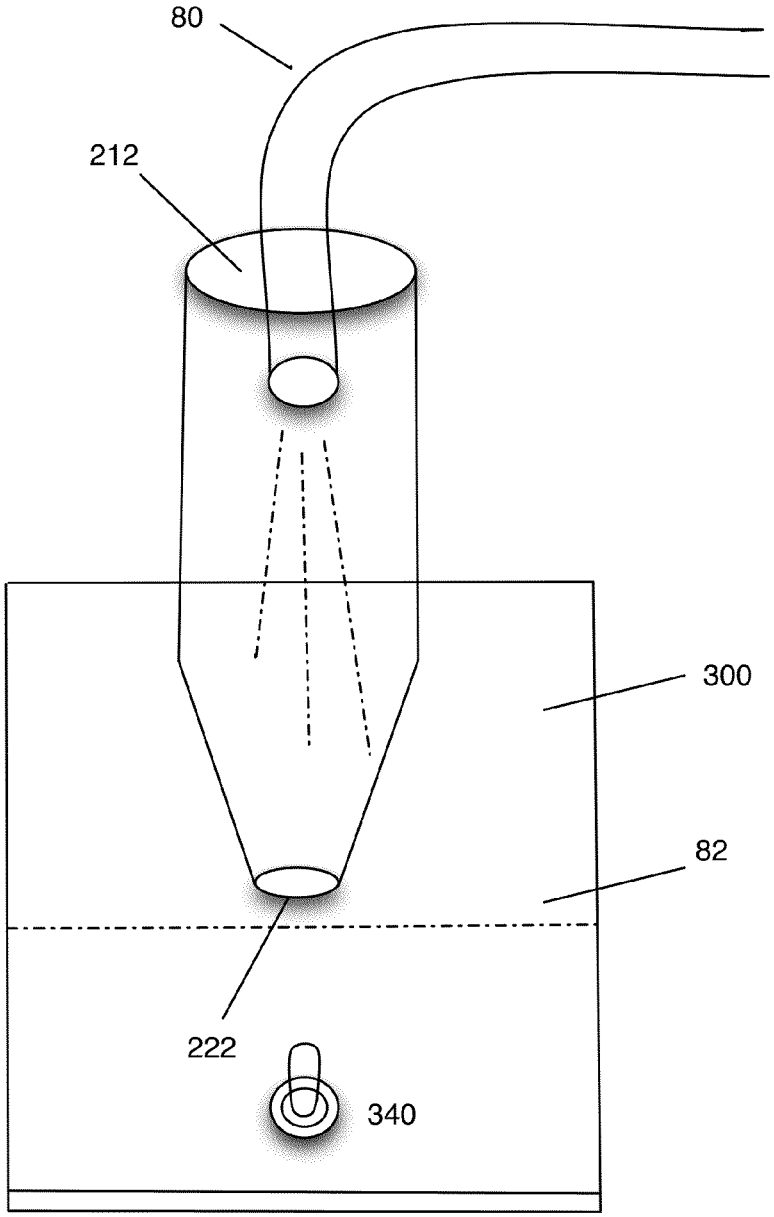
FIG. 5 shows the storage bag assembly of FIG. 4 being filled for dispensing.
Figure 7:
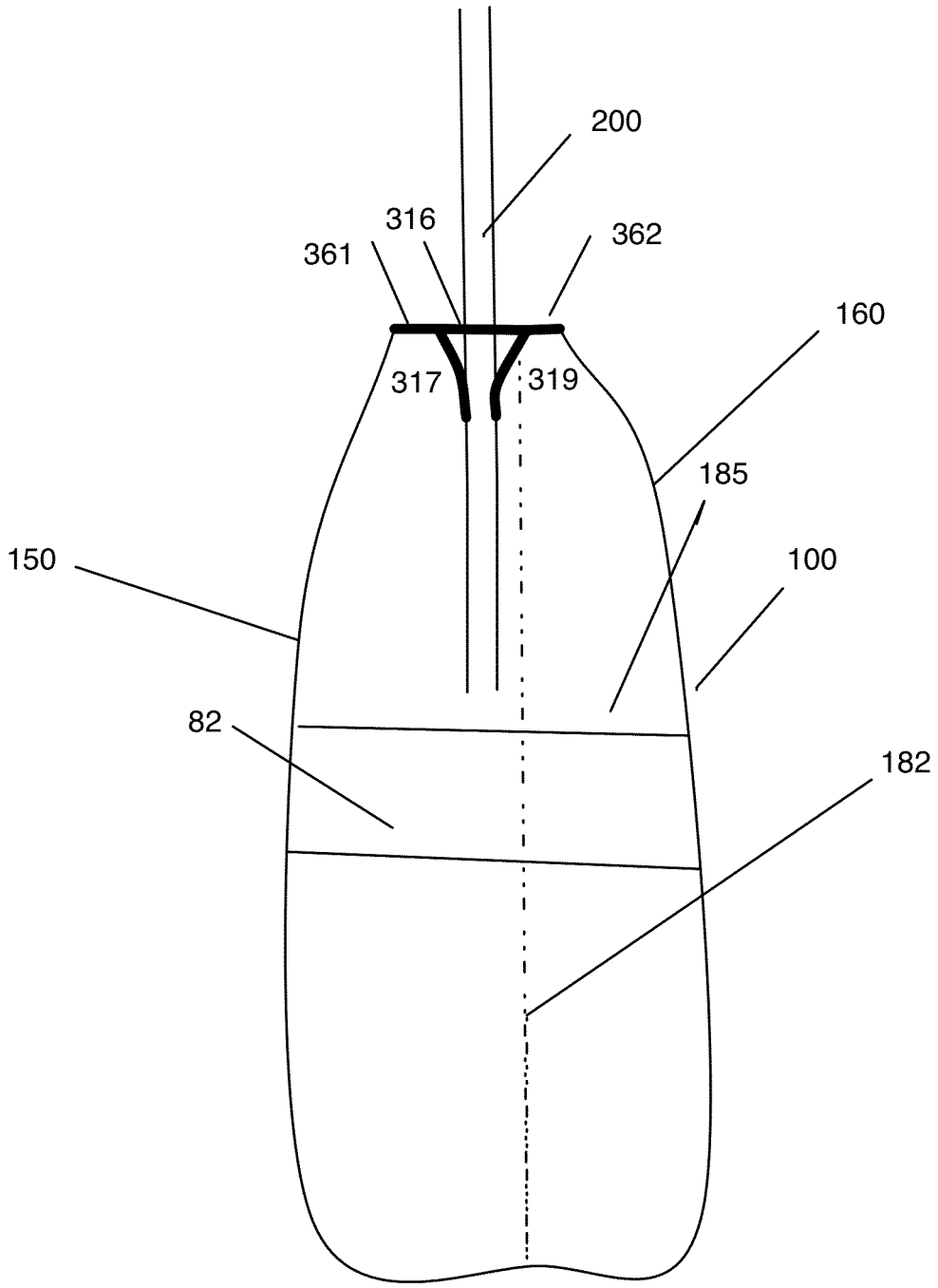
FIG. 7 is a vertical cross section view of the fill tube and storage bag when the storage bag is partially filled, as a liquid is introduced to the storage bag.

FIG. 5 shows a hydration bag assembly 300 formed by of FIG. 4 being filled for dispensing. In this example, the storage back is filled with water through a faucet 80 which provides water through the top opening 212 of fill tube 200. Referring to FIG. 7 which is a cross section view of the fill tube and storage bag, as a liquid is introduced to the storage bag, liquid will fall to the bottom of the storage bag and cause separation between the front panel 150 and the rear panel 160 of the storage bag. This separation may cause air to enter the storage bag through the fill tube. As described below, some or all of the air that is introduced through the fill tube may be removed by venting air out of the hydration port 330.

FIG. 5 shows the fill tube in condition for filling. The upper portion 270 of the fill tube 200 is opened up to permit introduction of the fill material. In this figure, water has filled the storage bag to level 82. A fill line 185 may be used to indicate the ultimate desired level of the storage bag liquid contents before air is removed as described below.

Figure 8:
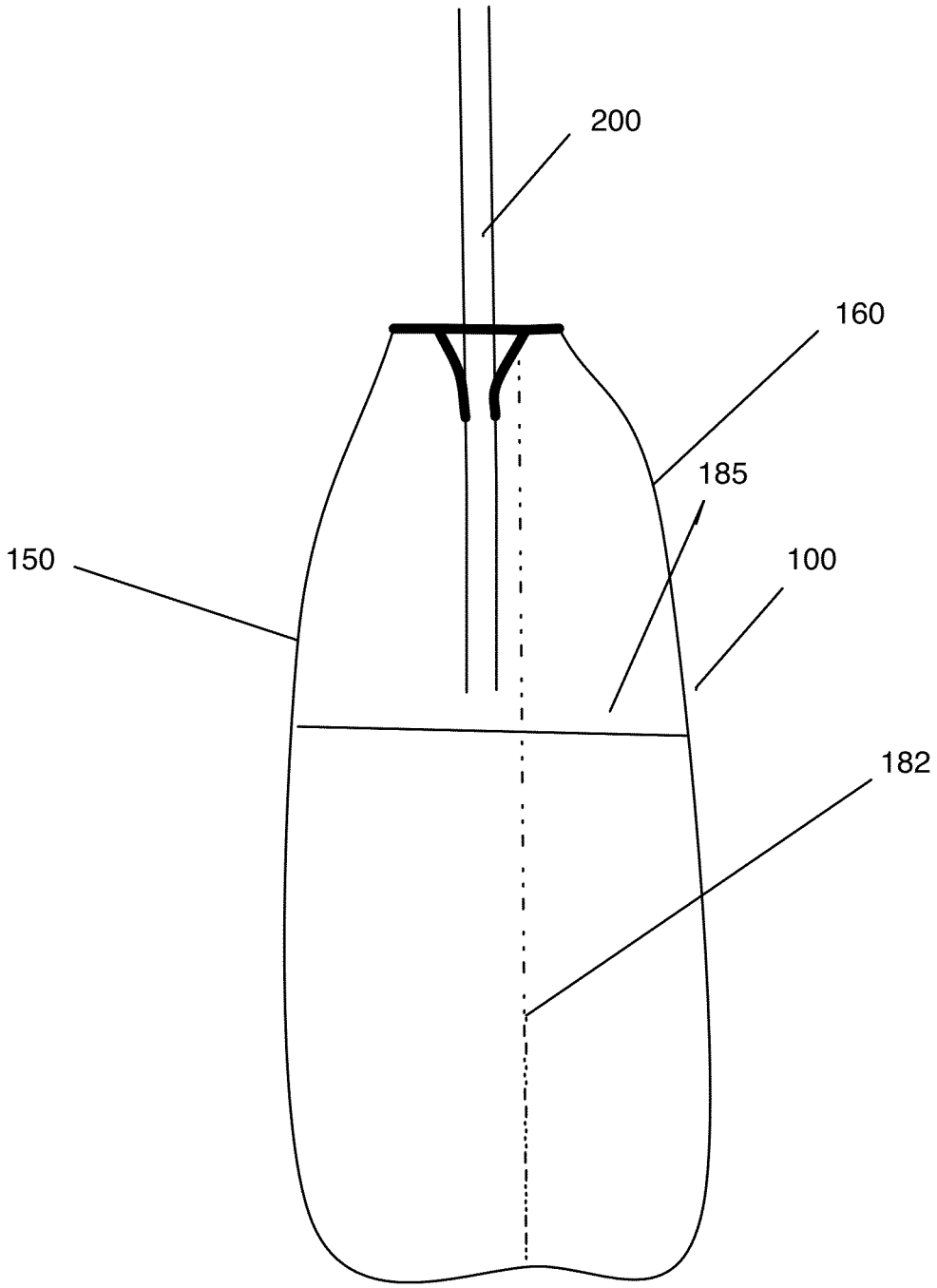
FIG. 8 is a vertical cross section view of the fill tube and storage bag when the storage bag is filled.

FIG. 8 is a vertical cross section view of the fill tube and storage bag when the storage bag is filled showing a liquid level 82 and an air pocket 83. The fill tube is collapsed at this point.

Figure 6:
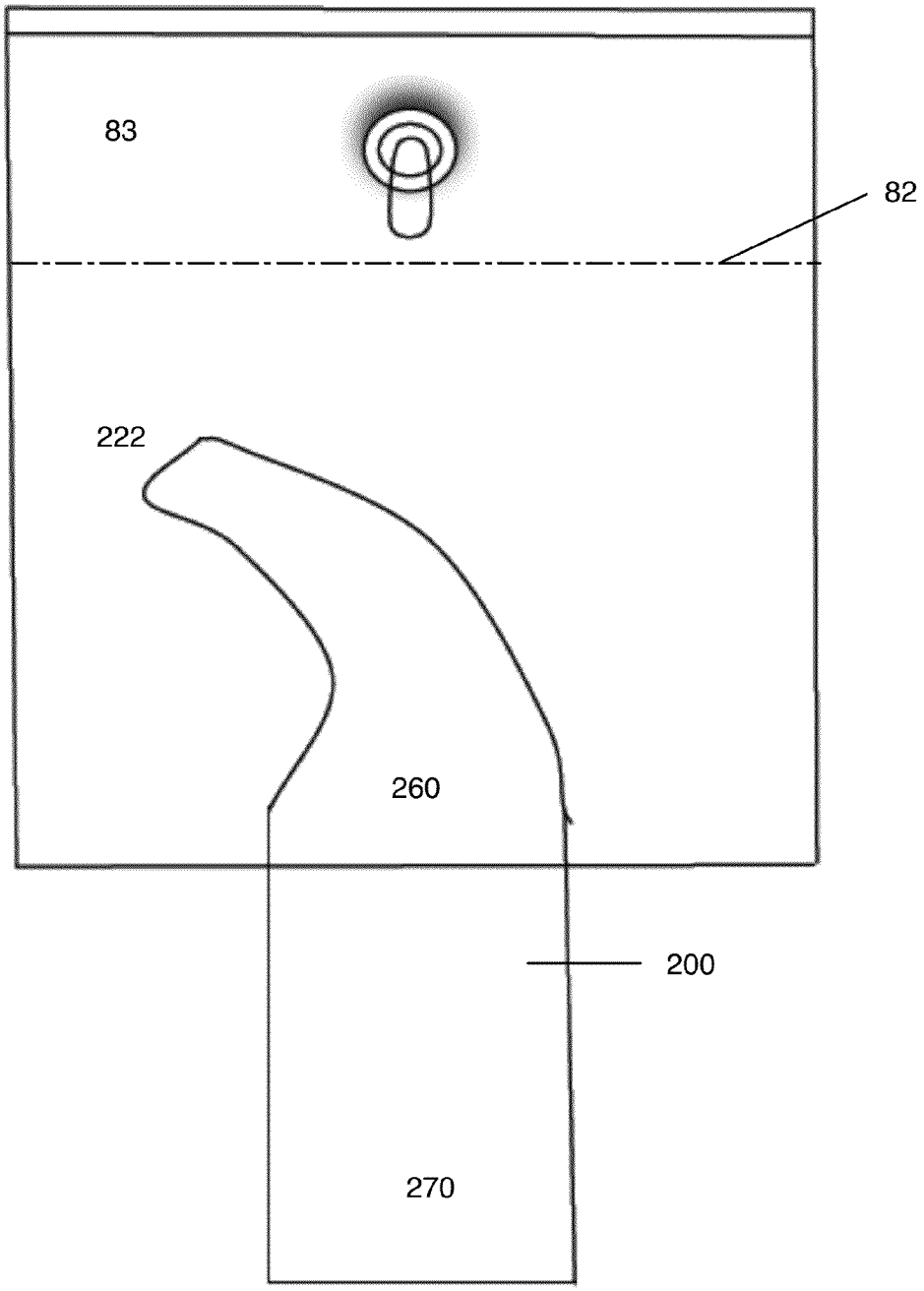
FIG. 6 shows the storage bag assembly of FIG. 5, quickly inverted so that the fill tube is sealed.

FIG. 6 shows the storage bag assembly 300 of FIG. 5, quickly inverted so that the fill tube 200 is sealed. When the bag is inverted, and the water level 82 is above the bottom opening 222 of the fill tube 200, the fill tube quickly collapses. The bottom portion 260 of the fill tube can float freely in the liquid that is contained in the storage bag. The effectiveness of the seal was unexpected, and may be promoted by the pressure of the the contents against the lower portion of the fill tube. When the storage bag is quickly inverted, the seal forms very quickly, and remains effective against leaks. Extensive testing has failed to produce a leak through the fill tube in cases of high pressure or vibration and sloshing of the contents.

Figure 13:
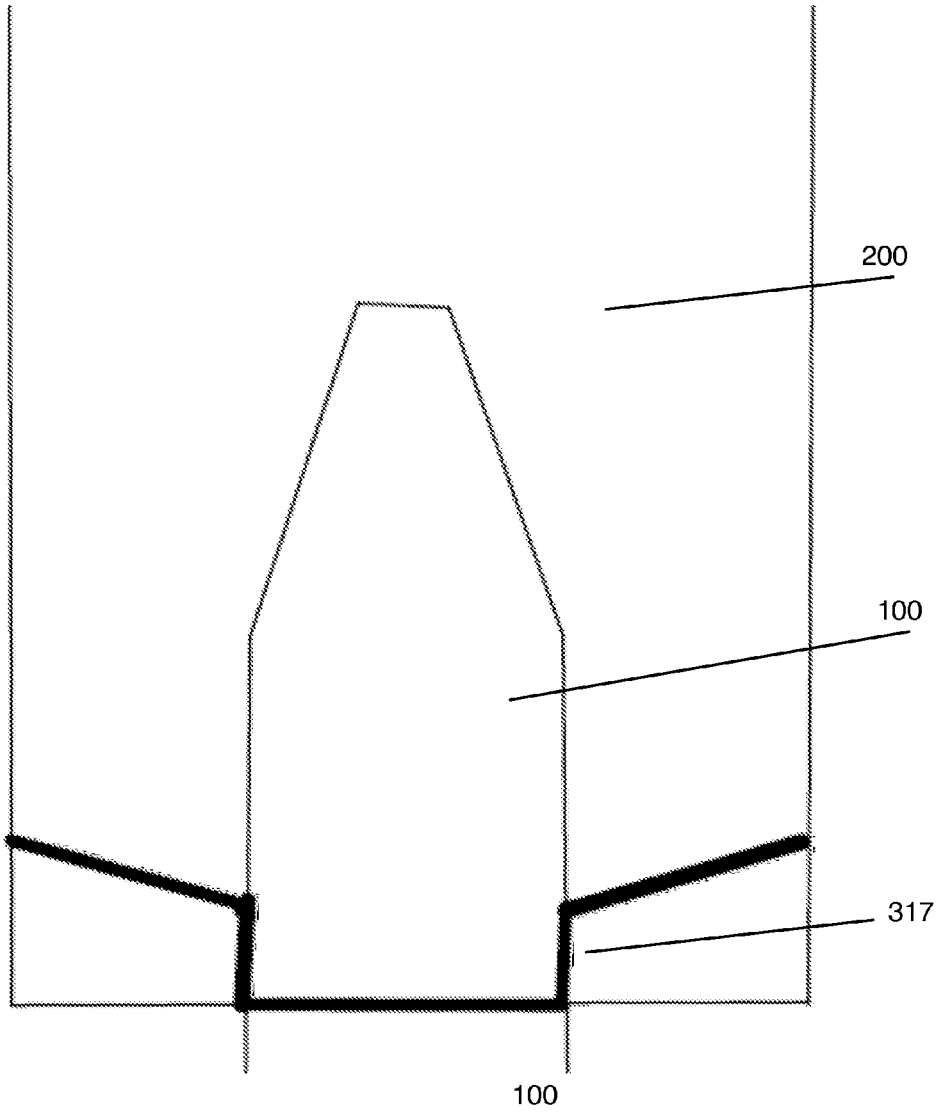
FIG. 13 is a side view of a filled and inverted hydration bag.

FIG. 13 is a side view of a filled and inverted hydration bag. This view shows the fill tube 100 sealing against content leakage of the storage bag 200.

Venting Air

After the inversion and collapse of the fill tube, the storage bag may be positioned on its side so that the drink tube is above the contents and upwardly-facing, and air may be bled from the bag through the drink tube or drink tube fitting. Although it is not necessary to bleed the air from the bag, it is often desirable to bleed some or all of the air to minimize sloshing of liquids or to fit a filled bag into a container such as a backpack. In these cases, the fill operation can be considered as a deliberate overfilling of the storage bag with liquid and air, followed by a removal of air. FIG. 9A is a horizontal cross section view of the fill tube and storage bag when the storage bag is filled and layered flat.

Figure 9B:
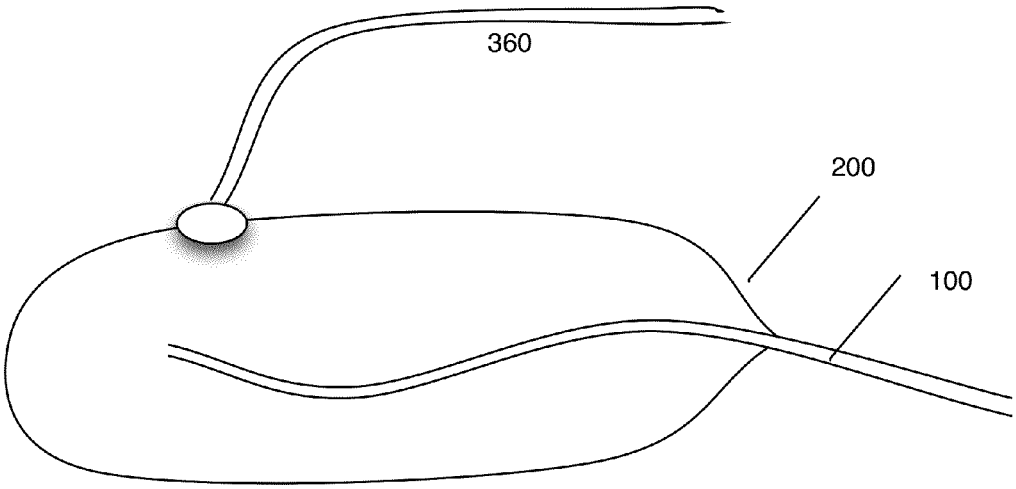
FIG. 9B is a horizontal cross section view of the fill tube and storage bag when the storage bag of FIG. 9A is vented.
Figure 9A:
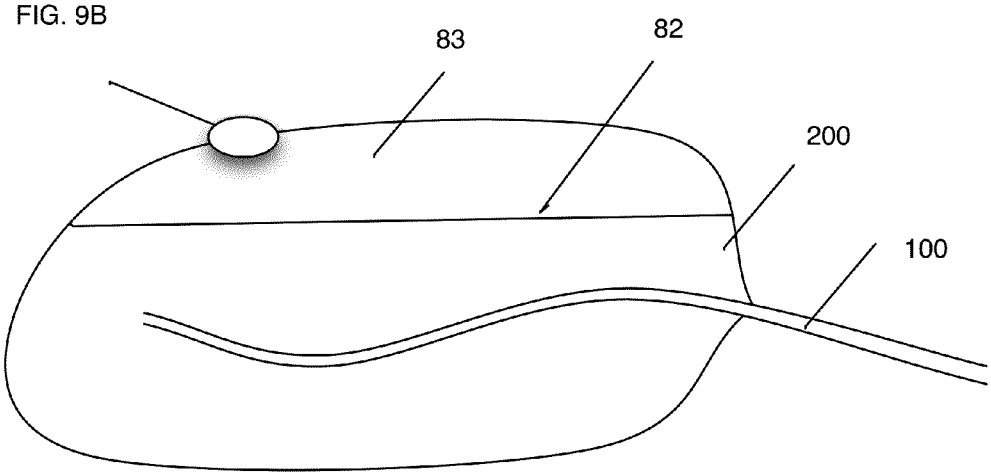
FIG. 9A is a horizontal cross section view of the fill tube and storage bag when the storage bag is filled and laid flat.
Figure 10:
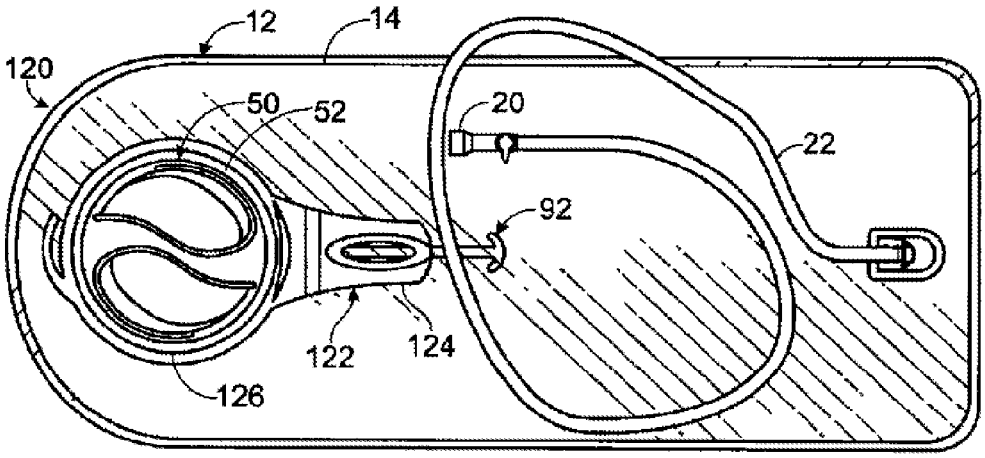
FIG. 10 (PRIOR ART)
FIG. 10 is a top view of a prior art Camelbak™ device.
Figure 11:
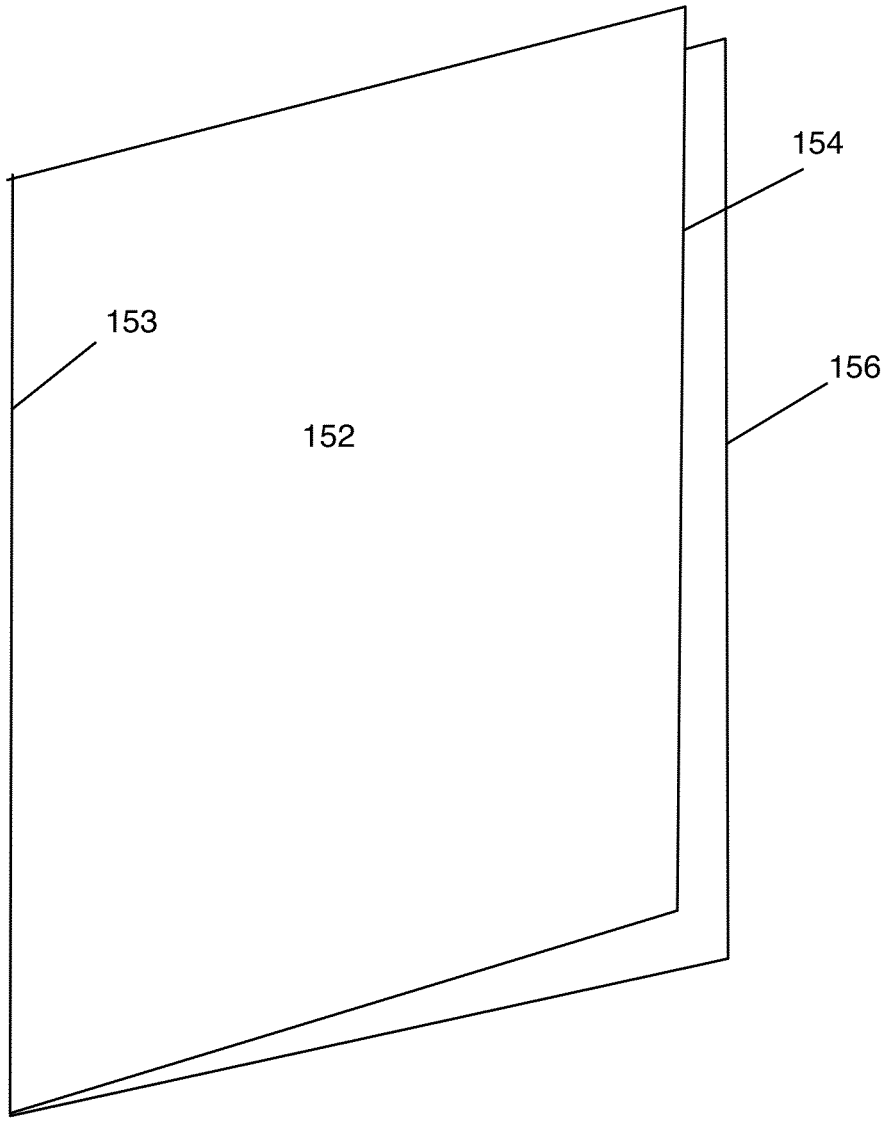
FIG. 11 is a top perspective view of an alternative bag construction with a single folded sheet.

FIG. 9B is a horizontal cross section view of the fill tube and storage bag when the storage bag of FIG. 9A is partially vented through drink tube 360.

Primary Fill Tube Sealing

The primary seal on the fill tube is provided when the fill tube collapses after the filling operation.

Secondary Sealing

The bag can have a fold over clip and seal, ziplock-type, or slider mechanism to seal the portion 270 of the fill tube which extends outside of the storage bag.

Method of Manufacture

In one method of manufacture, the collapsible fill tube is made from a single length of flat tubing by cutting a bottom funnel shape, and heat sealing side edges of the funnel.

In another method of manufacture, the collapsible fill tube is made from two panels by heat sealing side edges of the first panel as it overlays the second panel.

In one example, the storage bag is provided as an open-top prefabricated bag. A collapsible fill tube is inserted in the bag; and the storage bag top seal is created by heat sealing.

In another example, the storage bag is fabricated from a first side panel and a second side panel. The first side panel has a top edge, a first side edge, a second side edge, and a bottom edge. The second side panel has a top edge, a first side edge, a second side edge, and a bottom edge. The first panel is positioned over the second panel and the first side edge of the first panel is bonded to the first side edge of the second panel; the second side edge of the first panel is bonded to the second side edge of the second panel; and the bottom edge of the first panel is bonded to the bottom edge of the second panel.

In another example, the storage bag is fabricated from a single folded sheet which forms a first portion and a second portion joined at a fold. The single folded panel is folded so that the folded side edges are aligned and bonded; and the folded bottom edges are aligned and bonded. One method of forming a hydration bag with a collapsible self sealing fill tube comprises forming a funnel bottom on the section of flat tubing; placing the section of flat tubing with funnel bottom between the first panel and a second panel of a storage bag so that a lower portion of the fill tube extends into the storage bag by a distance greater than the length of the funnel bottom; and sealing a top portion of the storage bag. The sealing is performed by heat sealing an upper portion of the section of flat tubing to the first panel and the second panel in proximity to the top of the storage bag; creating a first storage bag top seal between the first side edge of the storage bag and the section of flat tubing; and creating a second storage bag top seal between the second side edge of the storage bag and the section of flat tubing. In one example, the funnel bottom is formed with a height greater than the flat tubing width, and with a bottom opening width of about half of the flat tubing width.

Alternate Designs

The quick loading/filling bag for hydration can be modified in numerous ways to accommodate a variety of needs. The following ideas are suggested, but not limiting:

Straight Fill Tube Inversion Preventers

FIG. 12 is a top view of an alternate hydration bag with straight inversion prevention seals 313. Testing has shown curved seals to be more effective than straight seals.

Gusseted Storage Bag

The embodiment above describes a a flat non-gusseted storage bag. The fill tube is also effective for other storage bag designs including gusseted designs. In one example, the bottom of the bag may lie flat on a support surface during the fill operation or during shipment or storage of the bag. Contents are introduced into the fill tube as described above, and the fill tube is collapsed after filling.

Disposable, recyclable, or Reusable bags

In on example, the storage bag and fill tube assembly is designed to be disposable and recyclable. The locking/dispensing mechanism can be built-in or removable and reused.

In another example, the storage bag and fill tube assembly can be refilled and reused.

Liquid or Solid Storage

The hydration bag described above typically contains less than a gallon of a liquid. In other examples, the storage bag and fill tube assembly can be much larger or smaller than the hydration application, and varying sizes can contain containing liquids or granular-type solids.

Storage of Bags

The filled storage bags can be placed or stored in anything that can support their weight.

On-Demand Mixing

The invention can accommodate multiple quick loading parts for filling and/or separation of certain materials/liquids, such as epoxies, before combining Materials The invention can be made from a variety of polyethylene, polypropylene and any other flexible materials.

The bag can be constructed of thicker outer materials while inner filling/tubing part is still very flexible and collapsible for filling giving it a check valve type of operation.

Dispensing

The bag storage can connect to a variety of fasteners, tubes and hoses for dispensing. In some applications, the assembly may comprise only a storage bag and a fill tube. In these applications, the contents can be accessed by cutting or otherwise opening the storage bag.

Method of Use

A method of filling and sealing the hydration bag comprises introducing a liquid through the top of the collapsible fill tube; continuing to introduce liquid through the collapsible fill tube until a desired liquid level is reached in the storage bag; and permitting the collapsible fill tube to collapse, thereby sealing the hydration bag. In one example, the storage bag is inverted so that the bag contents surround the portion of the fill tube which is within the storage bag. This inversion causes the fill tube to collapse and seal.

The following is an example method of use of a hydration bag assembly:

At step 1000, a hydration bag assembly such as shown in FIG. 4 is provided.

At step 1100, a liquid is introduced though the fill tube of the hydration bag assembly.

At step 1200, a liquid is introduced though the fill tube of the hydration bag assembly until the level of liquid in the storage bag reaches a desired level.

At step 1300, the hydration bag assembly is inverted, thereby causing the fill tube to collapse and seal.

At step 1400, excess air may be bled from the hydration bag.

At step 1500, the filled hydration bag is placed in a carrier such as a hydration backpack or pouch. The bag is typically held in the pouch with a notch or hook engaging a portion of the carrier.

At step 1600, the user may drink from the mouthpiece.

At step 1700, the user may re-fill the bag through the fill tube.

At step 1800, the user may replace the bag by removing it from the carrier and repeating steps 1000-1500.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A hydration bag comprising
a storage bag comprising
a top portion, and
a bottom portion;
a collapsible fill tube positioned partially within the storage bag, the collapsible fill tube comprising
a first panel having an inside surface, a first side edge, and a second side edge,
a second panel having an inside surface, a first side edge, and a second side edge,
a first fill tube side edge,
a second fill tube side edge, such that the first panel is connected to the second panel at the first fill tube side edge and the second fill tube side edge,
a top having a width, and
a funnel-shaped bottom portion having a bottom opening with a width less than the top width,
the collapsible fill tube having
a collapsed state with inside surface of the first panel in substantial contact with the inside surface of the second panel, and
an open state with the inside surface of the first panel spaced apart from the inside surface of the second panel,
such that an upper portion of the collapsible fill tube extends through top portion of the storage bag, and a storage bag top seal is provided, in proximity to the top of the storage bag, between the storage bag and the collapsible fill tube; and
a drink hole port.

2. The hydration bag of claim 1 wherein
the fill tube has a length of about 9 inches and a top width of about 4 inches;
about 6 inches of the fill tube extends into the storage bag; and
the funnel shaped bottom portion of the fill tube has a length of about 5 inches and a bottom opening width of about 2 inches.

3. The hydration bag of claim 1
wherein the collapsible fill tube comprises a single length of flat tubing formed by cutting a bottom funnel shape, and heat sealing side edges of the funnel.

4. The hydration bag of claim 1
wherein the collapsible fill tube first side edge and second side edge are formed by heat sealing edges of the first panel as it overlays the second panel.

5. The hydration bag of claim 1 further comprising
fill tube inversion preventers.

6. The hydration bag of claim 5 wherein the further fill tube inversion preventers further comprise
a first upwardly-convex inversion seal extending between the fill tube and a top portion of a first side of the storage bag; and
a second upwardly-convex inversion seal extending between the fill tube and a top portion of a second side of the storage bag.

7. The hydration bag of claim 1 further comprising
a drink tube assembly comprising
a first tube, external to the storage bag, the first tube having a proximal end connected to the drink hole port, and a second end.

8. The hydration bag of claim 1 wherein
the storage bag is provided as an open-top prefabricated bag;
the collapsible fill tube is inserted in the bag; and
the storage bag top seal is created by heat sealing.

9. The hydration bag of claim 1 wherein
the storage bag is fabricated from a first side panel comprising
a top edge,
first side edge,
a second side edge, and
a bottom edge,
and a second side panel comprising
a top edge,
first side edge,
a second side edge, and
a bottom edge; and
the first panel is positioned over the second panel, and
the first side edge of the first panel is bonded to the first side edge of the second panel,
the second side edge of the first panel is bonded to the second side edge of the second panel, and
the bottom edge of the first panel is bonded to the bottom edge of the second panel.

10. The hydration bag of claim 1 wherein
the storage bag is formed from a single folded sheet which forms a first portion and a second portion joined at a fold,
the storage bag comprising
a top edge,
first side edge,
a second side edge, and
a bottom edge;
such that the single folded panel is folded so that the first side edge is aligned with the second side edge, and
the first side edge is bonded to the second side edge,
the bottom edge of the first portion is bonded to the bottom edge of the second portion.

11. The hydration bag of claim 1 wherein
the storage bag and fill tube are formed from recyclable materials.

12. The hydration bag of claim 1 further comprising
a backpack or hydration bag container mounting hole.

13. A method of filling and sealing a disposable hydration bag, the method comprising
providing a first disposable hydration bag comprising
a storage bag comprising
a top portion, and
a bottom portion, a collapsible fill tube positioned partially within the storage bag, the collapsible fill tube comprising a funnel-shaped bottom portion, such that a storage bag top seal is provided, in proximity to the top of the storage bag, between the storage bag and the collapsible fill tube, and an access port;

introducing a liquid through the top of the collapsible fill tube;

continuing to introduce liquid through the collapsible fill tube until a desired liquid level is reached in the storage bag; and permitting the collapsible fill tube to collapse, thereby sealing the hydration bag.

14. The method of claim 13 wherein permitting the collapsible fill tube to collapse further comprises inverting the storage bag so that the bag contents surround the portion of the fill tube which is within the storage bag.

15. The method of claim 13 further comprising providing a secondary seal on the fill tube.

16. The method of claim 13 further comprising inserting the storage bag into backpack or hydration bag carrier.

17. A method of forming a hydration bag with a collapsible self sealing fill tube, the method comprising providing a section of flat tubing having a width, a first side edge, and a second side edge;

forming a funnel bottom on the section of flat tubing;

providing or forming a storage bag comprising a first panel and a second panel, the storage bag having a top portion, a first panel, a second panel, a first side edge and a second side edge;

placing the section of flat tubing with funnel bottom between the first panel and a second panel so that a lower portion of the fill tube extends into the storage bag by a distance greater than the length of the funnel bottom; and sealing a top portion of the storage bag by heat sealing an upper portion of the section of flat tubing to the first panel and the second panel in proximity to the top of the storage bag;

creating a first storage bag top seal between the first side edge of the storage bag and the section of flat tubing; and creating a second storage bag top seal between the second side edge of the storage bag and the section of flat tubing.

18. The method of claim 17 wherein forming a funnel bottom on the section of flat tubing further comprises forming a funnel bottom with a height greater than the flat tubing width, and with a bottom opening width of about half of the flat tubing width.

19. The method of claim 18 wherein sealing a top portion further comprises forming fill tube inversion preventers by heat sealing a first upwardly-convex inversion seal extending between a first point on the fill tube below the top of the bag, and a second point in proximity to the top of the storage bag that is wider than the fill tube, and heat sealing a second upwardly-convex inversion seal extending between a third point on the fill tube below the top of the bag, and a fourth point in proximity to the top of the storage bag that is wider that the fill tube; and forming a heat seal between the second point and the fourth point, such that the heat seal seals the flat tubing to the first panel of the storage bag and to the second panel of the storage bag.

20. The method of claim 17 further comprising providing a drink hole port on the storage bag; and connecting a drink tube to the drink hole port.

* * * * *